US006433756B1

(12) United States Patent
Sievenpiper et al.

(10) Patent No.: US 6,433,756 B1
(45) Date of Patent: Aug. 13, 2002

(54) METHOD OF PROVIDING INCREASED LOW-ANGLE RADIATION SENSITIVITY IN AN ANTENNA AND AN ANTENNA HAVING INCREASED LOW-ANGLE RADIATION SENSITIVITY

(75) Inventors: Daniel F. Sievenpiper, Los Angeles; James H. Schaffner, Chatsworth; Hui-Pin Hsu, Northridge; Gregory L. Tangonan, Oxnard, all of CA (US)

(73) Assignee: HRL Laboratories, LLC., Malibu, CA (US)

( * ) Notice: Subject to any disclaimer, the term of this patent is extended or adjusted under 35 U.S.C. 154(b) by 0 days.

(21) Appl. No.: 09/905,796

(22) Filed: Jul. 13, 2001

(51) Int. Cl.[7] ..... H01Q 15/02

(52) U.S. Cl. ..... 343/909; 343/700 MS; 343/756

(58) Field of Search ..... 343/700 MS, 909, 343/756

(56) References Cited

U.S. PATENT DOCUMENTS

| | | | | |
|---|---|---|---|---|
| 4,308,541 A | | 12/1981 | Seidel et al. | 343/786 |
| 4,760,402 A | | 7/1988 | Mizuno et al. | 343/713 |
| 4,821,040 A | | 4/1989 | Johnson et al. | 343/700 MS |
| 5,177,493 A | | 1/1993 | Kawamura | 343/713 |
| 5,208,603 A | * | 5/1993 | Yee | 343/909 |
| 5,541,614 A | | 7/1996 | Lam et al. | 343/792.5 |
| 5,682,168 A | | 10/1997 | James et al. | 343/713 |
| 5,818,394 A | | 10/1998 | Aminzadeh et al. | 343/713 |
| 5,850,198 A | | 12/1998 | Lindenmeier et al. | 343/713 |
| 5,892,485 A | * | 4/1999 | Glabe et al. | 343/789 |
| 5,917,458 A | * | 6/1999 | Ho et al. | 343/909 |
| 5,929,819 A | | 7/1999 | Grinberg | 343/754 |
| 6,005,521 A | | 12/1999 | Suguro et al. | 343/700 MS |
| 6,037,912 A | | 3/2000 | DeMarre | 343/815 |
| 6,046,655 A | | 4/2000 | Cipolla | 333/137 |
| 6,081,239 A | | 6/2000 | Sabet et al. | 343/753 |
| 6,091,367 A | | 7/2000 | Kabashima et al. | 343/700 MS |
| 6,208,316 B1 | * | 3/2001 | Cahill | 343/909 |
| 6,218,978 B1 | * | 4/2001 | Simpkin et al. | 343/909 |

FOREIGN PATENT DOCUMENTS

| | | | |
|---|---|---|---|
| WO | 99/50929 | 10/1999 | H01Q/1/38 |

OTHER PUBLICATIONS

Balanis, C.,"Aperture Antennas," *Antenna Theory, Analysis and Design*, 2nd edition, John Wiley & Sons, New York, Chap. 12, pp. 575–597 (1997).

Balanis, C., "Microstrip Antennas," *Antenna Theory, Analysis and Design*, 2nd edition, John Wiley & Sons, New York, Chap. 14, pp. 722–736 (1997).

Perini, P. and C. Holloway, "Angle and Space Diversity Comparisons in Different Mobile Radio Environments," *IEEE Transactions on Antennas and Propagation*, vol. 46, No. 6, pp. 764–775 (Jun. 1998).

Vaughan, R., "Spaced Directive Antennas for Mobile Communications by the Fourier Transform Method," *IEEE Transactions on Antennas and Propagation*, vol. 48, No. 7, pp. 1025–1032 (Jul. 2000).

* cited by examiner

*Primary Examiner*—Don Wong
*Assistant Examiner*—Hoang Nguyen
(74) *Attorney, Agent, or Firm*—Ladas & Parry

(57) ABSTRACT

An improved low-angle radiation antenna is obtained through excitation of a tangential electric field on the high-impedance surface, as well as leaky transverse-electric surface waves. Such fields and surface waves cannot normally occur on an ordinary metal surface. The tangential electric field on the high-impedance region excites a transverse-magnetic surface wave on a surrounding metal surface which gives improved low-angle radiation in the E-plane of an antenna disposed on the high impedance surface. Leaky transverse-electric surface waves provide improved radiation in the H-plane of the antenna.

21 Claims, 6 Drawing Sheets

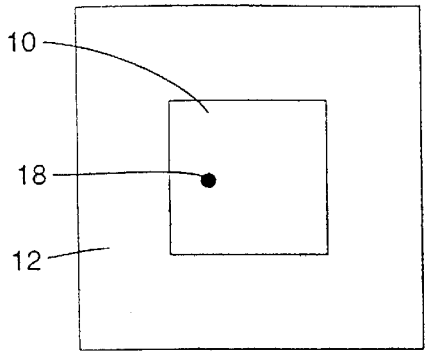
Figure 1a
prior art
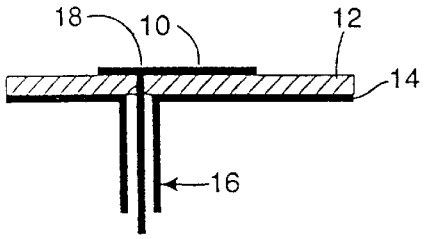
Figure 1b
prior art
Figure 3a
prior art
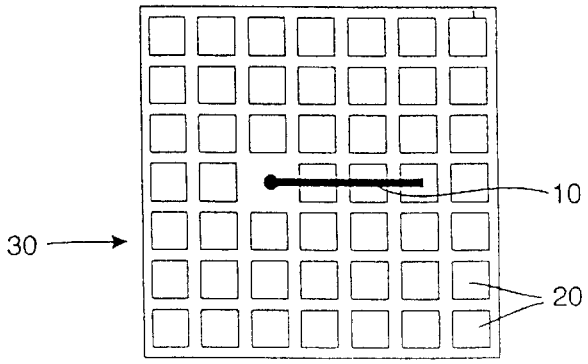
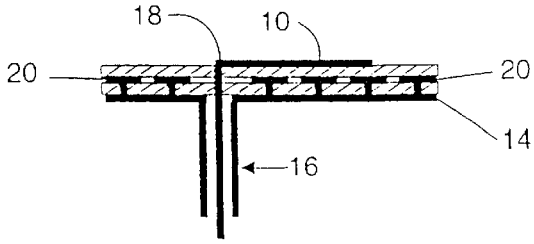
Figure 3b
prior art

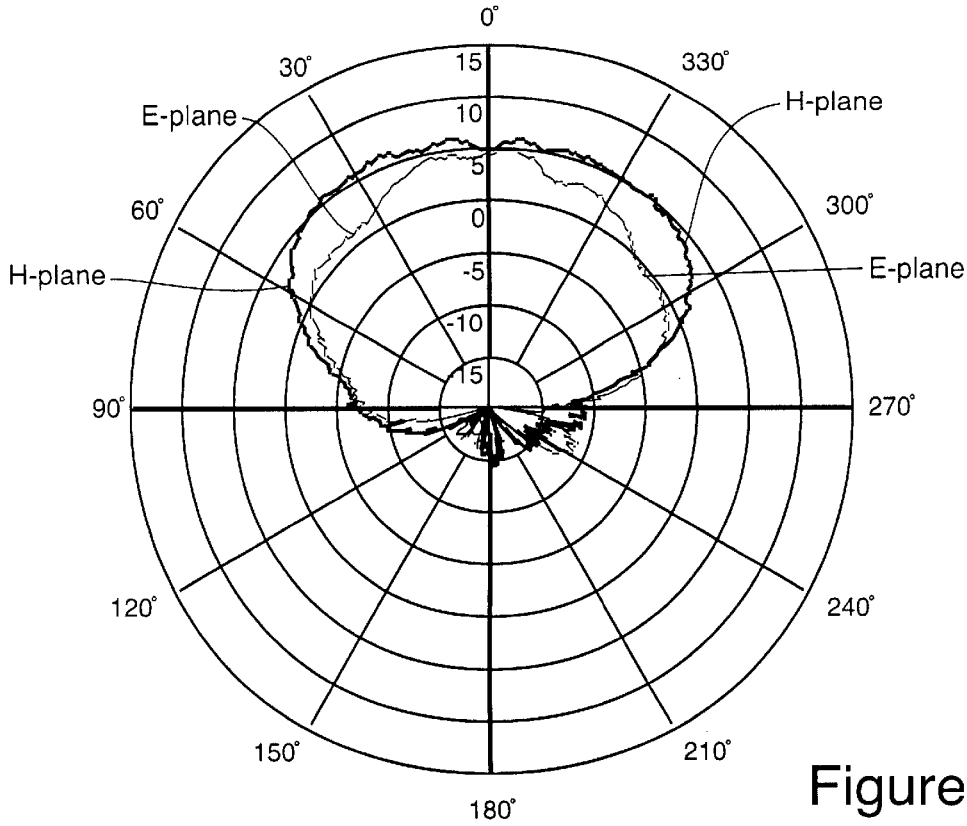
Figure 9
Figure 10
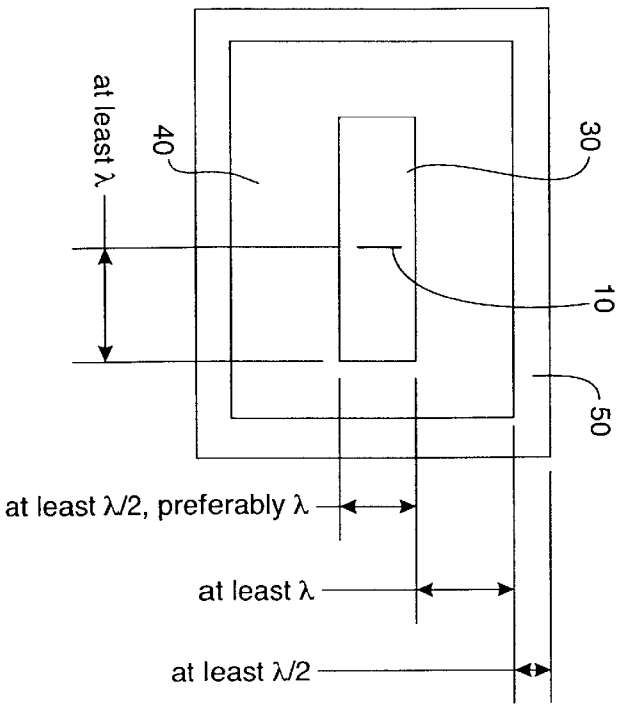

METHOD OF PROVIDING INCREASED LOW-ANGLE RADIATION SENSITIVITY IN AN ANTENNA AND AN ANTENNA HAVING INCREASED LOW-ANGLE RADIATION SENSITIVITY

TECHNICAL FIELD OF THE INVENTION

This invention relates to thin or low-profile antennas, and particularly to thin or low-profile antennas having good radiation capacities for receiving and/or sending radio frequency signals at a low angle to the major surface of the antenna.

BACKGROUND AND FEATURES OF THE INVENTION AND CROSS REFERENCE TO RELATED APPLICATIONS

The standard telecommunications (e.g. cellular telephone) antenna seen on the exteriors of automobiles today is a vertical antenna. This antenna presents a number of difficulties. First, it is not suitable for use with satellite communication services including current GPS and direct satellite broadcast services since those services may rely on satellites positioned most or less overhead where the vertical antenna lacks sensitivity. Second, future telecommunication systems will put more demands upon antennas. If vertical antennas were used to try to meet this demand, a number of antennas would be installed on the roof of a vehicle and as the desired performance of the antennas increased so would their number—a forest of antennas could result. Third, these vertical antennas are (i) unsightly, (ii) subject to increased risk of breakage and damage and (iii) non-aerodynamic, particularly as their numbers increase. Forth, vertical antennas are effective only with vertically polarized radio frequency signals. A modern antenna needs to be able to handle both vertical and non-vertical emissions—satellite emissions are apt to be circularly polarized.

The ideal antenna for a vehicle, such as an automobile, would be an antenna which:

(1) has a very small profile (so that it does not protrude in any significant way from the surface of the vehicle in which it is mounted);

(2) can handle radio frequency signals of different polarizations; and (3) has both acceptable low angle (to the major surface of the antenna) efficiency and at the same time can handle communications with satellites positioned overhead.

The present invention has advantages for producing low-angle radiation from a low-profile antenna. The antenna may be horizontally mounted and, indeed, it may be conveniently mounted on or in the exterior surfaces of vehicles such as automobiles, trucks, trains and aircraft. With the future introduction of high-speed third-generation wireless data communication systems, such as third generation cellular systems, there will be a need for antennas that have appreciable gain near the horizon, since these systems will be primarily involving communications with ground base stations. Furthermore, for satellite-based direct broadcast radio and two-way communication systems there is also a need for the antenna to have significant gain at angles as low as 30 degrees from the horizon or lower as well as have the capability to serve satellites which are positioned overhead.

For mobile users in vehicles, one possible location for such an antenna is in the roof of the vehicle over the occupant area, which provides a broad area that can accommodate multiple antennas. However this can involve radiating at a low angle across a large metal surface, which is difficult particularly for horizontal or circular polarizations. Historically, the only way to produce significant antenna gain near the horizon is to provide an antenna with significant vertical height—usually a large fraction of a wavelength depending on the antenna design. The use of a tall vertical antenna reduces the aerodynamic performance of the vehicle and is often quite undesirable for aesthetic styling purposes.

The present invention provides a good alternative, because it provides a specific method for producing low-angle radiation for horizontal, vertical, and circular polarizations while at the same time maintaining a low-profile shape. Antennas using this technique typically have a vertical height of much less than one-quarter wavelength.

The prior art includes the following patent application owned by UCLA: D. Sievenpiper and E. Yablonovitch, "Circuit and Method for Eliminating Surface Currents on Metals" U.S. provisional patent application serial No. 60/079953, filed Mar. 30, 1998 and corresponding PCT application PCT/US99/06884, published as WO99/50929 on Oct. 7, 1999, the disclosures of which are hereby incorporated herein by reference.

Related patent applications include the following U.S. Patent Applications all of which are hereby incorporated hereby by reference:

1) D. Sievenpiper, R. Harvey, G. Tangonan, R. Y. Loo, J. Schaffner, "A Tunable Impedance Surface", U.S. Ser. No. 09/537,923, filed Mar. 29, 2000.

2) D. Sievenpiper, T. Y. Hsu, S. T. Wu, D. M. Pepper, "An Electronically Tunable Reflector", U.S. Ser. No. 09/537,922, filed Mar. 29, 2000;

3) D. Sievenpiper, G. Tangonan, R. Loo, J. Schaffner, "A Tunable Impedance Surface", U.S. Ser. No. 09/589,859, filed Jun. 8, 2000.

4) D. Sievenpiper, J. J. Lee, S. Livingston, "An End-Fire Antenna or Array on a Surface with Tunable Impedance", U.S. Ser. No. 09/537,921, filed Mar. 29, 2000;

5) D. Sievenpiper, J. Schaffner, "A Textured Surface Having High Electromagnetic Impedance in Multiple Frequency Bands", U.S. Ser. No. 09/713,119, filed Nov. 14, 2000.

6) D. Sievenpiper, H. P. Hsu, "A Polarization Converting Reflector", U.S. Ser. No. 09/520,503, filed Mar. 8, 2000;

7) D. Sievenpiper, H. P. Hsu, G. Tangonan, "Planar Antenna with Switched Beam Diversity for Interference Reduction in Mobile Environment", U.S. patent application Ser. No. 09/525,831 filed Mar. 15, 2000.

8) D. Sievenpiper, "A Vivaldi Cloverleaf Antenna", U.S. Ser. No. 09/525,832, filed Mar. 15, 2000.

9) D. Sievenpiper, A. Schmitz, J. Schaffner, G. Tangonan, T. Y. Hsu, R. Y. Loo, R. S. Miles, "A Low-Cost HDMI-D Packaging Method for Integrating a Novel and Efficient Reconfigurable Antenna ces and High Impedance Surface", U.S. Ser. No. 09906035 filed Jul. 13, 2001.

10) J. Schaffner, D. Sievenpiper, J. Lynch, R. Y. Loo, "A Reconfigurable Antenna for Multiple-Band, Beam Switching Operation", U.S. Ser. No. 09/629,681, filed Aug. 1, 2000.

11) D. Sievenpiper, H. P. Hsu, J. Schaffner, G. Tangonan, "Low-profile, Multi-antenna Module, and a Method of Integration into Vehicle", U.S. Ser. No. 09/905,757, filed on the same date as the present application.

As is briefly discussed above, with the advent of broadband wireless communication systems, there is a need for antennas that can meet stringent performance criteria. At the same time, vehicle styling and/or aerodynamic requirements prohibit the use of unsightly "antenna farms or forests" with multiple vertical antennas protruding from the surface of a vehicle. Hence, new antennas must not only have increased functionality to handle modern broadband wireless communication systems, but must also have a low-profile and should be conformable to the shape of the vehicle. In many situations, these two requirements are in direct conflict. For example, in modern communications systems, antennas should be able to handle low-angle radiation. For terrestrial systems, in which a mobile user is communicating with one or more base stations, the user must radiate energy at or near the horizon and typically in the microwave frequencies. For a handset such as a cellular phone, this is accomplished easily with a vertical whip antenna, which produces a nearly omnidirectional radiation pattern. For vehicle antennas, which are typically mounted on the top of the roof in order to obtain unobstructed coverage of all azimuthal angles, the presence of a large metal ground plane complicates the situation. In this case, a vertical monopole antenna is still sufficient for vertical polarization. However, as more functionality is added to the antenna, such as diversity combining, or beamforming, multiple monopole antennas then are needed, resulting in an unsightly and unaerodynamic "antenna farm or forest". Furthermore, if horizontal polarization or circular polarization is required, the vertical monopole antenna is not a viable option.

Other antennas exist which have a low-profile and are capable of generating any desired polarization. The most common example of such an antenna is the patch antenna which consists of a small flat metal shape separated from a ground plane by a thin dielectric layer. One disadvantage of the patch antenna is that it cannot radiate effectively at low angles, rather it radiates the bulk of its energy in a direction normal to the ground plane. This is true of many low-profile antennas, particularly those having horizontal polarization or circular polarization (which consists of equal parts of horizontal and vertical polarization which are out of phase by 90 degrees). The reason for this is that a conductive ground plane does not allow the presence of a tangential electric field at its surface. In order to radiate at low angles (to the ground plane), the antenna must be able to generate a wave that skims across the metal surface, parallel or nearly parallel to the metal itself. This may be thought of as a kind of a surface wave. Vertically polarized radiation may occur at the horizon if the ground plane supports transverse-magnetic (TM) surface waves. Conversely, horizontally polarized radiation may occur at low angles if the ground plane supports transverse-electric (TE) surface waves. The fact that a flat metal surface does not support the propagation of TE surface waves is consistent with the fact that low-angle radiation with horizontal polarization is impossible from a conventional low-profile antenna. It is only when a conventional antenna is elevated a significant distance from its ground plane that it can effectively radiate at low angles. From another point of view, the effective image of the antenna in the ground plane cancels the radiation from the antenna in the case of horizontal polarization.

One possible solution to this problem is to use a high-impedance (Hi-Z) surface as the ground plane. The high-impedance surface consists of a flat sheet of metal covered by a two-dimensional array of resonators that can be analyzed as LC circuits, in which the resonance frequency is determined by the sheet inductance L and the sheet capacitance C. Near its resonance frequency, the surface provides an electromagnetic boundary condition that is the opposite of an ordinary metal surface, and it behaves as an effective magnetic conductor. The reader is directed to the other co-pending applications noted above and to PCT publication WO99/50929 also noted above for additional information relating to high impedance (Hi-Z) surfaces. This may seem to be a good choice for producing low-angle, horizontally polarized radiation. However, in its conventional form, the high-impedance surface fails at this task just as the metal surface does. The reason for this is that near its resonance frequency, the high-impedance surface suppresses both TM and TE surface waves. Thus, an antenna on such a surface cannot generate low-angle radiation of either polarization, and instead radiates most of its energy normal to the major surface thereof.

However, in connection with the present invention, it has been determined that it is possible to build an antenna that generates both horizontal and vertical polarization at low angles through an understanding of two non-obvious observations:

(1) High-impedance surfaces support leaky TE surface waves at frequencies above their resonance frequency, which can be used to generate horizontally polarized low-angle radiation.; and (2) These leaky TE surface waves can also couple to TM surface waves on a nearby metal surface to generate vertically polarized radiation at low angles. Thus, with the proper combination of high-impedance surface and low-impedance surface (metal), one can build an antenna that produces low-angle radiation of both horizontal and vertical polarizations.

One common antenna that is known in the prior art is the patch antenna, shown in FIGS. 1*a* and 1*b*. It consists of a small shape of metal 10, usually circular or rectangular, that lies parallel to a larger metal sheet that serves as its ground plane 14. It is separated from this ground plane by a thin insulator 12 that is typically much less than one-quarter wavelength thick. It is often fed by a coaxial line 16, as shown in these figures, with the center conductor thereof being coupled to a feed point 18 on the patch antenna's active element 10; however, other kinds of feeds may be used, such as a microstrip feed, or an aperture coupled feed. The length of the patch is generally equal to ½n, where n is the refractive index of the substrate material. Thus, for a substrate with a higher refractive index (or dielectric constant), a patch antenna can be made shorter. It acts as a half-wavelength resonant cavity, and it radiates within a narrow band around its resonant frequency. A typical radiation pattern for this prior art patch antenna is shown in FIG. 2. In FIG. 2, the E-plane is shown in a thin line while the H-plane is shown in a thick line. In both planes, the radiation intensity tends towards zero near the horizon and is maximal normal to the surface. In is embodiment, the patch antenna 10 was mounted over a square metal ground plane 18 measuring twenty four inches (61 cm) on a side.

While the patch antenna is low-profile and suitable for mounting on the exterior of a vehicle, it is not very effective for producing low-angle radiation, particularly in a horizontal polarization. The reason for this is the presence of the metal ground plane, which suppresses the propagation of electromagnetic waves that have their electric field oriented parallel to the metal surface.

One alternative to the prior art patch antenna of FIGS. 1*a* and 1*b* is the high-impedance (Hi-Z) surface 30, shown in FIGS. 3*a* and 3*b*, with a suitable antenna element 10 disposed thereon. The Hi-Z surface 30 consists of a metal surface or ground plane 14 covered with a two-dimensional lattice of metal resonant elements 20, which typically resemble "thumbtacks" protruding from the metal ground plane 14. Near the resonance frequency, the Hi-Z surface 30 provides a boundary condition that is opposite to that of a flat conductive surface. This allows antenna elements, such as antenna element 10 depicted by FIGS. 3*a* and 3*b*, to lie directly adjacent to the Hi-Z surface 30 without being shorted out, resulting in antennas that are much less than one-quarter wavelength thick, yet radiate effectively within a particular frequency band. An example of such an antenna element is the horizontal bent-wire antenna 10 shown in FIGS. 3*a* and 3*b*, but other types of antennas may be used instead, including one or more patch antennas. A bent-wire antenna is typically one-third to one-half wavelength long and consists of a wire that extends from the back of the surface (the wire which extends may be simply the center conductor of a coaxial cable) to the front, where it is bent over parallel to the surface. More than one antenna could be used on the surface and, ordinarily, more than one antenna would be used. This would be done to provide a particular desired radiation pattern, or perhaps several different radiation patterns, so that one could switch among the patterns. The operating frequency of antenna 10 is determined by the properties of the Hi-Z surface 30, in particular its sheet capacitance and sheet inductance, as well as by the size of antenna 10. For a surface with sheet capacitance C, and sheet inductance L, the resonance frequency will be $$\omega = \frac{1}{\sqrt{LC}}$$

and the bandwidth will be $$BW = \frac{\sqrt{L/C}}{377}.$$

The antenna element 10 is depicted as being coupled to a coaxial line 16, as shown in FIG. 3*b*, with the center conductor thereof being coupled to a feed point 18 on the antenna element 10; however other kinds of feeds may be used, such as a microstrip feed or an aperture coupled feed. The metal resonant element(s) 20 which would otherwise be in the way of the feed point 18 is (are) omitted in this embodiment so that the feed point 18 is not shorted to the ground plane 14. Alternatively, the feed point 18 can be located in the regions between resonant elements 20. The metal resonant elements would in an actual embodiment be much smaller than that depicted in FIGS. 3*a* and 3*b* and are depicted enlarged in these figures for ease of illustration. The size of the elements 20 is largely governed by the frequency (and bandwidth) at which the Hi-Z surface is to operate as governed by the aforementioned equations.

Near the resonance frequency, the Hi-Z surface 30 has the additional property that it suppresses the propagation of surface waves. In many antenna applications this is a desirable property, because the antenna will not excite unwanted currents on or in nearby metal objects. This can be particularly important for electromagnetic interference (EMI) reduction, and electromagnetic compatibility (EMC) concerns, in which it is desirable to minimize the amount of coupling between nearby electronic devices or other nearby antennas. In order to accomplish this goal, a conventional Hi-Z surface is employed under or around an antenna 10 and the antenna 10 is operated at or near the resonance frequency of the Hi-Z surface.

BRIEF DESCRIPTION OF THE PRESENT INVENTION

In one aspect the present invention provides a technique to produce an electrically thin antenna that has increased low-angle radiation in comparison with other antennas having a similar profile. It does this by using an area of a high-impedance surface which is encompassed by a larger region of metal surface. Producing improved low-angle radiation is accomplished through the excitation of a tangential electric field on the high-impedance surface, as well as leaky transverse-electric surface waves. Such fields and surface waves cannot normally occur on an ordinary metal surface. The tangential electric field on the high-impedance region excites a transverse-magnetic surface wave on the surrounding metal surface which gives improved low-angle radiation in the E-plane of the antenna. The leaky transverse-electric surface waves provide improved radiation in the H-plane of the antenna.

One of the novel features of the present invention is based upon the use of a high-impedance (Hi-Z) surface outside its usual operating region (which is the surface wave band gap) and instead operating in a different region (the transverse-electric surface wave region). Instead of trying to suppress surface waves, as is usually done with conventional Hi-Z surfaces, the present invention, according to one aspect thereof, takes advantage of a Hi-Z surface by using it not in a frequency region where it suppresses surface waves, but in a frequency region where it supports leaky TE surface waves in order to achieve improved low angle radiation. Thus, in one aspect the present invention includes (i) the use of a high-impedance surface (which may by itself be of a conventional design) at frequencies outside of its usual operating mode, and (ii) a geometry consisting of a combination of high-impedance surface and low-impedance (for example, metal) surface which are designed to achieve the desired low-angle radiation pattern.

BRIEF DESCRIPTION OF THE DRAWINGS

FIG. 1*a* is a plan view of a schematic representation of a patch antenna;

FIG. 1*b* is a side sectional view through the patch antenna depicted by FIG. 1*a*

FIG. 3*a* is a plan view of a schematic representation of a prior art high-impedance (Hi-Z) surface with an antenna disposed thereon;

FIG. 3*b* is a side sectional view of the prior art high-impedance (Hi-Z) surface with an antenna disposed thereon shown in FIG. 3*a;*

FIG. 9 is a radiation pattern of the elongated Hi-Z surface of FIG. 8; and FIG. 10 is a plan view of the preferably elongated Hi-Z surface disposed in a metal surface which in turn is preferably surrounded by a region of High-Z or lossy material.

DETAILED DESCRIPTION OF THE A PREFERRED EMBODIMENT PRESENT INVENTION

Figure 2:
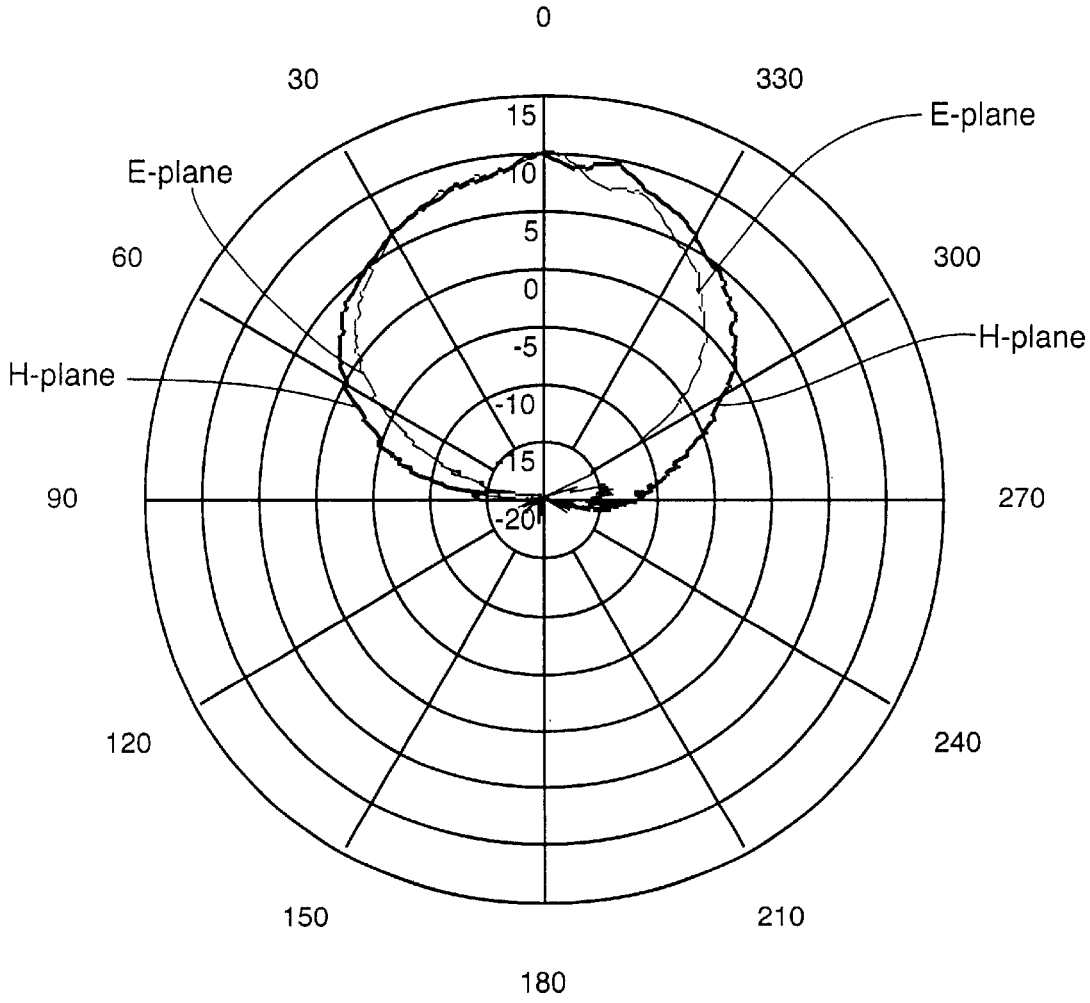
FIG. 2 is a graph of a typical radiation pattern for the prior art patch antenna shown in FIGS. 1*a* and 1*b;*
Figure 4A:
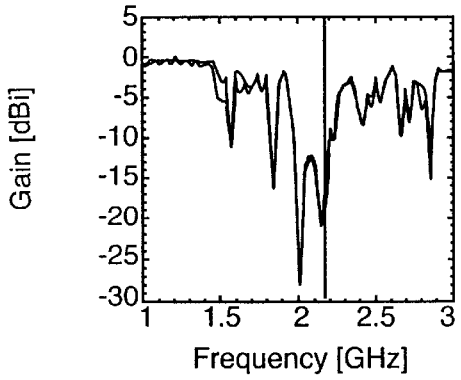
FIGS. 4*a*–4*c* represent the results of initial experiments performed in connection with the antenna described herein.
Figure 4B:
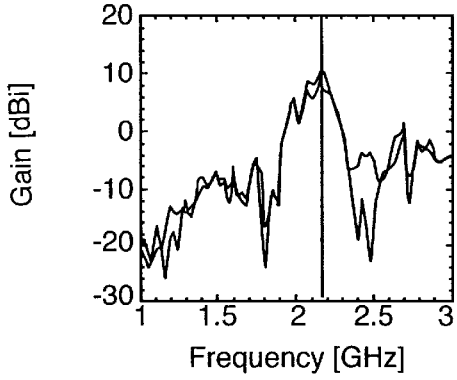
Figure 4C:
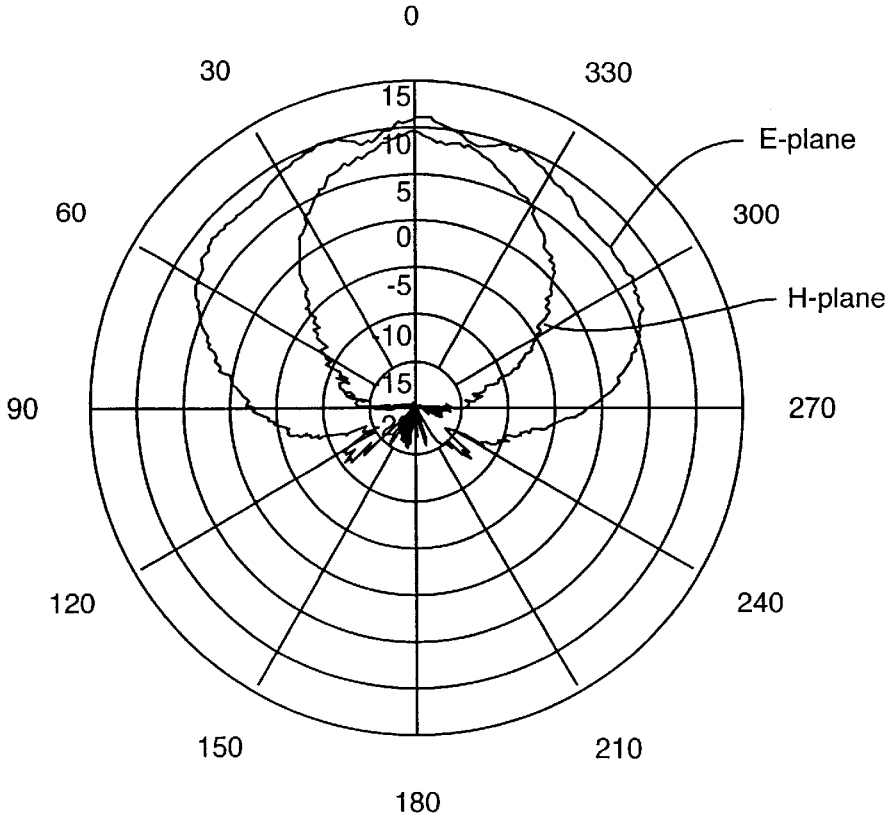

In some situations, it is desirable to enhance surface currents, or to excite them to a greater degree than would be possible with an ordinary antenna. It has been found experimentally that this can also be done using a conventional Hi-Z surface, by operating it in a frequency range in which it is not normally used, that is, in a leaky TE wave range. Results of experiments which were performed are shown in FIGS. 4*a*–4*c*. As can be seen by reference to FIG. 4*c,* the H-plane radiation pattern is similar to that of the patch antenna, but the E-plane radiation pattern shows greatly enhanced radiation near the horizon. The E-plane is the plane that is perpendicular to the surface, and which contains the wire. The H-plane is perpendicular to both the surface and the wire.

Figure 7:
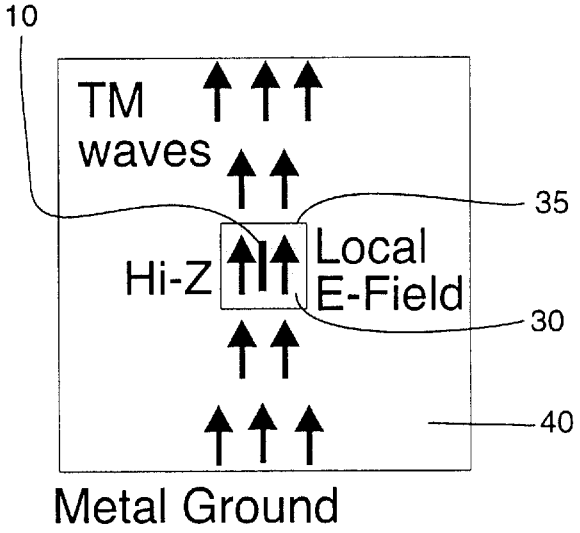
FIG. 7 shows that the Hi-Z surface of FIG. 6 surrounded by a larger metal surface.

One experiment was performed as follows: The antenna under test consisted of a thin wire that was about 4 cm long. It was centered in a 12 cm by 12 cm Hi-Z surface 30 which was centered on a 60 cm by 60 cm metal ground plane 40. The resonance frequency of this particular Hi-Z surface was about 2.05 GHz. The antenna was operated at about 2.20 GHz, near the upper edge of the band gap, where the surface supports leaky TE waves. The return loss of the surface is shown in FIG. 4*a* and the gain of the antenna in the normal direction is shown in FIG. 4*b*. As is evident from the FIGS. 4*a* and 4*b,* the antenna was operated near the upper part of its operating range to achieve the results described herein. The antenna was operated at the frequency shown by a vertical line in FIG. 4*a*. This was near the upper edge of the band gap, which is also the upper edge of the operating band of the antenna. In this range, the Hi-Z surface supports leaky TE surface waves, which allows it to achieve greater low-angle radiation. The antenna used in the experiment is depicted by FIGS. 3*a*, 3*b*, and 7.

The Hi-Z surface 30 can be quite thin. It preferably has a thickness which is less than 0.1λin height. A Hi-Z surface can be made thicker than 0.1λ, but the thicker it is the less aerodynamic the antenna is apt to be and/or the more difficult it will be to install in an aerodynamic fashion on a vehicle. The wire antenna 10 and other antennas which might be used in lieu of a wire antenna are likely to be even thinner than the Hi-Z surface 30 since they can be provided by any convenient thickness of metal sheet or metal foil as they may be directly mounted on and supported by the Hi-Z surface 30. As a result, the overall thickness of the antenna is very likely to be less than 0.1λ. λ is the wavelength of the antenna operating frequency. For the 2.2 GHz antenna noted above, λ is about 12 cm. The antenna's thickness could be on the order of 1 mm.

FIG. 4*b* depicts the gain in the forward direction of the wire antenna in the afore-described experiment. In the upper frequency range of the operating band of the antenna, it is able to achieve increased low-angle radiation (as is described herein) by coupling into leaky TE surface waves, which can in turn excite TM surface waves in the surrounding metal ground plane FIG. 4*c* depicts the radiation pattern of the square high-impedance surface antenna on the 60 cm by 60 cm metal ground plane. The E-plane pattern is shown in a thin line, and the H-plane pattern is shown in a thick line. The H-plane pattern is very similar to that of the previously discussed patch antenna, while the E-plane pattern shows significant improvement in low-angle radiation. This is caused by coupling the tangential electric field on the Hi-Z surface into TM surface waves on the adjacent metal surface. This is evidenced by the ripples in the E-plane radiation pattern, which indicate the presence of surface waves.

Figure 5:
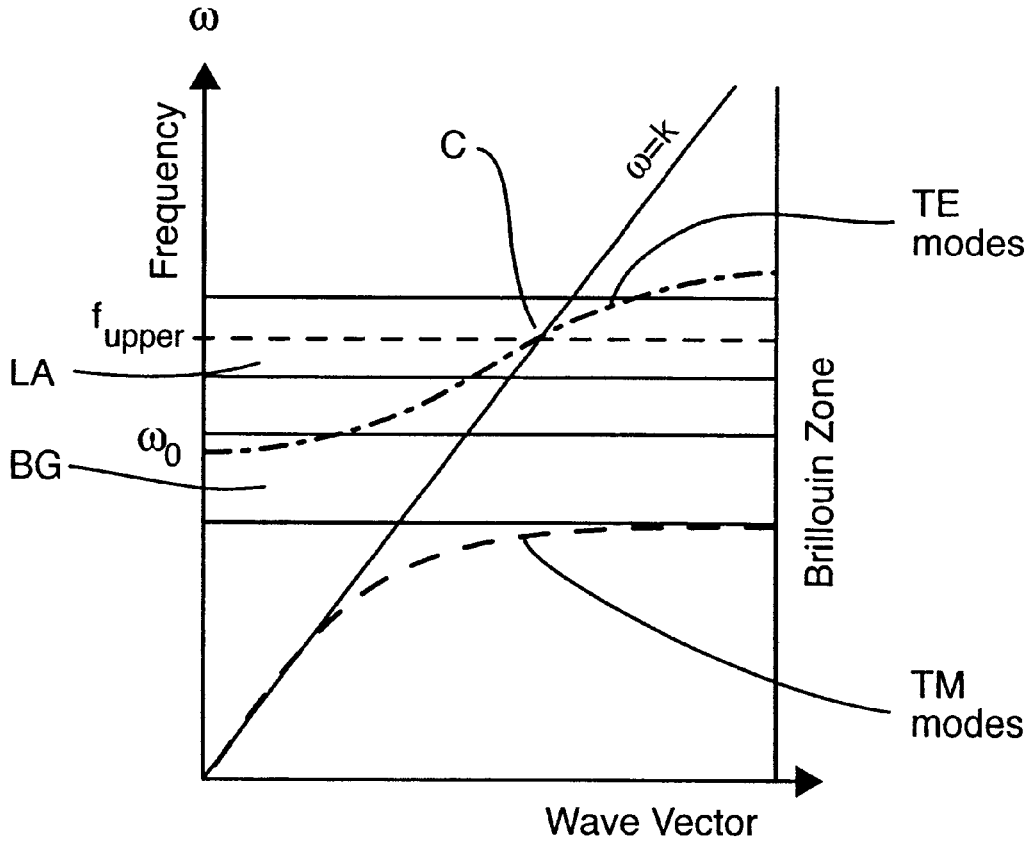
FIG. 5 is the dispersion diagram for surface waves on a Hi-Z surface.

The reason for this enhanced low-angle radiation in the E-plane can be understood by considering FIG. 5, a dispersion diagram for surface waves on a Hi-Z surface. In FIG. 5 TM modes are shown in a dashed line, and while TE modes are shown in a dotted and dashed line. A diagonal line, labeled ω=k, indicates the behavior of light in free space. The TE modes that exist to the left of the diagonal line are leaky waves, and can radiate from the surface, while those to the right of the diagonal (or light) line are bound to the surface. Typically, Hi-Z surfaces are used near the resonance frequency, labeled $\omega_0$, in the region labeled BG (BG stands for Band Gap and is used to depict the preferred operating region for prior art band gap operation). For improved low-angle radiation, a high-impedance surface is operated instead in region LA (LA stands for Low Angle) which region is centered on point C where the TE band crosses the diagonal (light) line. Below the resonance frequency $\omega_0$ (in region BG), the surface supports TM surface waves, in which the magnetic field lies transverse to the direction of propagation and parallel to the major surface of the antenna. Above the resonance frequency $\omega_0$, the surface supports TE surface waves, in which the electric field is transverse to the direction of propagation and parallel to the major surface of the antenna. TE surface waves do not normally propagate on flat conductive surfaces because conductors forbid tangential electric fields from existing at their surface. Such waves can only propagate on surfaces that have a capacitive impedance, such as the Hi-Z surface operating above its resonance frequency. Under normal (prior art) operation, the preferred region to use a Hi-Z surface is in the band gap region BG, where it supports neither TM nor TE surface waves, or in the lower part of the TE band, where the TE surface waves radiate rapidly away from the surface in a direction that is nearly normal to the surface.

The band gap region extends up to point C where the TE band crosses the light line. However, designers typically try to stay near the middle to lower part of this region where there are few or no TE waves. This preferred portion of the Band Gap region is identified as region BG in FIG. 5 The LA region thus extends from the upper part of the band gap region to a region above the band gap region where the TE band crosses the light line.

In the prior art, the Hi-Z surface would be used in frequency range BG, in the lower half of the band gap, or in the lower section of the leaky TE wave region, where the waves radiate rapidly from the surface. In accordance with the present invention, the Hi-Z surface is operated instead in the upper part of the band gap or above that region (in region LA), where the leaky TE waves are more closely bound to the surface, and thus propagate for a longer distance across it. The fact that these waves can be used for increasing low-angle radiation that is an important feature of the present invention.

In accordance with one aspect of the present invention, a Hi-Z surface is operated in region LA which may be defined as being the region $f_{upper} \pm BW/4$ where $f_{upper}$ is defined as the frequency corresponding to point C (i.e. the upper end of the band gap) and BW is the Band Width of the band gap region. This definition translates into the following definition of the frequency band of the LA region:

$$\frac{1}{2\pi\sqrt{LC}}+\frac{\sqrt{L/C}}{(4)(377)}<f<\frac{1}{2\pi\sqrt{LC}}+\frac{3\sqrt{L/C}}{(4)(377)}$$

where C=the sheet capacitance and L=the sheet inductance.

In this frequency range LA, the surface supports TE surface waves, and those surface waves do not radiate rapidly from the surface, but instead propagate nearly adjacent to the surface and gradually leak away. This allows an antenna to produce enhanced low-angle radiation.

Figure 6:
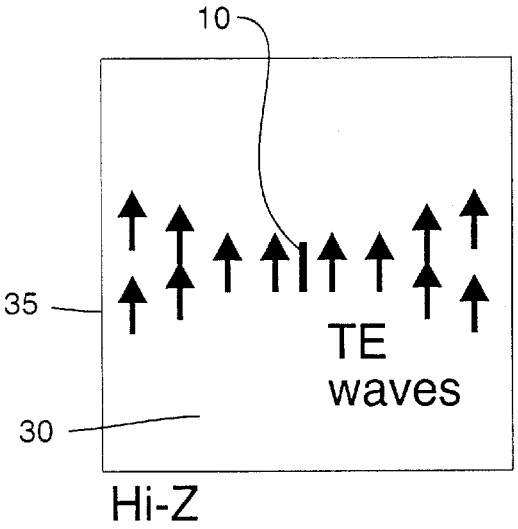
FIG. 6 depicts a small wire antenna on a large Hi-Z surface.
Figure 8:
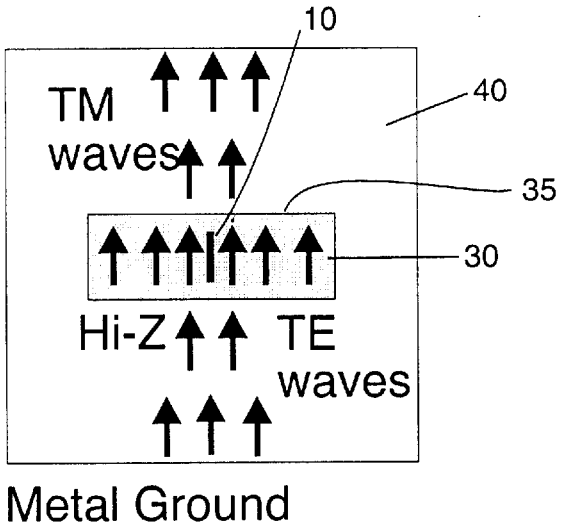
FIG. 8 depicts another improved high-impedance surface antenna, which provides improved low angle radiation in both the E-plane and the H-plane.

FIG. 6 shows a wire antenna 10 on a Hi-Z surface 30. The wire antenna excites leaky TE surface waves when operated in the LA region, which waves radiate away as they propagate across the surface. This geometry could cause increased radiation in the H-plane. The TE waves will cause low-angle radiation in the H-plane unless, as was determined in the experiments, the high impedance surface 30 is of a small size (about one λ on a side) and is surrounded by a larger region of ordinary metal 40 (FIGS. 7 and 8).

The foregoing explanation suggests that the antenna of the afore-described experiment should have had enhanced low-angle radiation in the H-plane (the plane in which TE waves propagate), as shown in FIG. 6. However, instead improved radiation in the E-plane (the plane in which TM waves propagate) was found. The reason for this is that the area of Hi-Z surface 30 that was used in the experiments was 12 cm square, or roughly one wavelength square at 2.5 GHz. Low angle radiation was also obtained in the H-plane in later experiments by increasing the size of the Hi-Z surface in that direction. In the initial experiment, the surface was only about one wavelength square, which was not large enough to see the results which had been initially expected. In the later experiments, it was determined that the high impedance surface 30 should be about three wavelengths (3λ) in width (i.e. in the H-plane) to produce horizontally polarized low-angle radiation.

The Hi-Z surface 30 surrounded by a larger metal surface 40 is shown in FIG. 7. For coupling to occur between these two surfaces 30, 40, they should touch or effectively touch each other in order for the current to flow from one to the other. The Hi-Z surface may be disposed on top of the ground plane 40 and it may be disposed in an opening in the ground plane, so long as the ground plane 14 of the Hi-Z surface 30 is electrically continuous with the ground plane 40. In FIG. 7, the comparatively smaller region of Hi-Z surface 30 supports a small wire antenna 10 on the comparatively larger metal ground plane 40. The Hi-Z surface region 30 is, in this embodiment, on the order of one wavelength (1λ) in size along it's edges. As previously mentioned, for the H-plane improvement discussed above, the Hi-Z surface 30 should preferably be wider or about 3λ in width and this embodiment is shown in FIG. 8 (which is more fully discussed below). In either case the larger metal ground plane 40 is at least two wavelengths (2λ) wide but preferably many wavelengths wide. Thus, the Hi-Z surface 30 preferably has a size (length:width) in the range of 1λ:1λto 1λ:3λ, based on the information presented so far. As will be seen, this range is actually somewhat bigger.

The Hi-Z surface 30 supports TE surface waves, but, due to its comparatively smaller size, they appear as simply a standing tangential electric field at the surface of the antenna. This field is able to couple to TM surface waves, which are supported by the surrounding metal surface, and cause enhanced low-angle radiation in the E-plane. This occurs as long as there is a large enough tangential electric field where the edge 35 of the Hi-Z surface 30 touches the surrounding metal ground plane 40. This may require that the Hi-Z surface 30 be small enough in the direction of the E-plane that the leaky TE waves can "reach" the edge 35 before radiating away. Based the experiments performed, it appears that if the Hi-Z surface 30 is on the order of ½ wavelength (0.5λ) wide in the direction of the E-plane, the coupling works well. It is likely that the surface 30 could be somewhat larger or smaller and the effect could still be achieved, as long as the antenna 10 is operated in the LA frequency range with respect to the resonance frequency $\omega_0$ of the Hi-Z surface 30. Thus, the high-impedance surface preferably has a length in the range of 0.5λ to 1λ to produce vertically polarized low-angle radiation and preferably has a width in the range of 1λ to 3λ to produce horizontally polarized low-angle radiation. The length to width dimensions of the Hi-Z surface 30 preferably fall in the following range: 0.5λ:1λ to 1λ:3λ (length:width). It should be appreciated that length and width dimensions can fall outside this range somewhat and the antenna will exhibit desirable qualities in terms of radiation patterns so long as the antenna is operated in the LA region of the Hi-Z surface 30 as previously described. However, it is believed that the best results occur when: (1) the length to width dimensions of the Hi-Z surface 30 falls in the range of 0.5λ:1λ to 1λ:3λ and (2) the antenna is operated in the LA region of the Hi-Z surface 30.

Waves are defined as being leaky if they can radiate from the surface. For a wave described by $E(x)=Ce^{j(k+j\gamma)x}$ the wave is leaky when γ is on the order of k.

The preferred size ranges of the Hi-Z 30 and metal ground plane 40 are depicted in FIG. 10 which will be more fully discussed below. Also, should be appreciated that while the ground plane is preferably at least two wavelengths on a side, in practice it is apt to be much larger and may very well not be square. For example, if the Hi-Z surface 30 where mounted on a wing or the hull of a airplane used to carry freight or passengers, the wing or hull of the aircraft would likely be used to serve as the ground plane in which case the wing or hull would be many wavelengths in dimensions and its shape would not be square. As will be seen the shapes of the Hi-Z surface 30 and the ground plane 40 are not believed to be particularly critical.

The conductive, and preferably metal, surface 40 preferably surrounds the Hi-Z surface 30 completely. However, it is likely that gaps in the conductive surface may be tolerated and thus it is expected that the conductive surface 40 need not completely surround the Hi-Z surface. At the same time it is believed that it would be preferable if the conductive surface 40 completely surrounds the Hi-Z surface 30.

Describing a propagating surface wave makes little sense when it propagates over a distance of less than one wavelength, and such a situation is better described as a standing tangential electric field that covers the area of the Hi-Z surface 30, and stops at its interface 35 with the metal 40. This tangential field cannot propagate across the metal because of its low impedance, so the low-angle radiation in the H-plane is weak. However, this standing tangential field is ideally suited for generating a TM surface wave on the surrounding metal, which will propagate at a low angle in the direction of the E-plane. The Hi-Z surface 30 is effectively acting as an aperture in the metal surface 40, which supports a standing tangential electric field over the entire area of the Hi-Z surface 30.

As such, when the antenna is put on a automobile, for example, the metal over the occupant compartment then might be used as the ground plane and thus becomes a radiating element. To keep RF out of the passenger compartment a second area 50 of Hi-Z surface or a lossy material may be provided near the edge of the roof (i.e. on the periphery of ground plane 40) to block the propagation of surface currents beyond that periphery. In FIG. 10 not only are the preferred sizes of the Hi-Z surface and the ground plane 40 shown in terms of wavelengths, but also the second area 50 is depicted as preferably providing a 0.5λ (or wider) wide margin around the ground plane 40. In the aircraft example previously given, it is expected that, given the size of the ground plane, propagation into the passenger compartment is likely to be de minimis. However, if it is not de minimis then a marginal second area 50 of Hi-Z surface or a lossy material may be provided near the peripheral edge of the ground plane 40.

This result can be easily understood by considering FIG. 5 again, which shows the surface wave dispersion diagram of the Hi-Z surface 30. The surface 30 supports TM waves below the band gap, which is centered around the resonance frequency $\omega_0$. It supports TE waves above the band gap that are bound to the surface. Within the band gap, it also supports TE surface waves, but they exist as leaky waves that radiate readily from the surface 30. On a large surface, these leaky TE waves generate low-angle radiation in the H-plane, as shown in FIG. 6. However, the geometry of the initial experiments is as shown in FIG. 7. If the Hi-Z surface is small, these leaky TE waves simply form a standing tangential electric field on the surface. In other words, it does not make sense to describe them as propagating waves if they propagate over a distance of less than a wavelength. This tangential field then excites TM surface waves in the surrounding metal 40, which is simply the ordinary surface current that occurs on regular metals. This current propagates along the E-plane at a low angle to the horizon.

A lossy material is defined as a material in which the loss tangent (electric, magnetic, or both electric and magnetic) is significantly greater than zero and preferably about 1.

The next experiment is shown in FIG. 8. In this experiment the Hi-Z surface 30 was sized such that the distance along the H-Plane was three times longer than the length along the E-Plane. The E-plane dimension was 1λ while the H-plane dimension was 3λ. This elongated high impedance region allowed the leaky TE waves to propagate over a larger distance before encountering the surrounding metal surface 40. If the surface 30 is able to provide the leaky TE waves with sufficient propagation distance before reaching the surrounding metal 40, this results in an improvement in low angle radiation in the H-Plane. Currents are also generated in the surrounding metal, causing low-angle radiation in the E-plane.

FIGS. 7 and 8 suggest that this antenna is directional, which is indeed the case. So, a vehicle very well might have several such antennas and would preferably be provided with diversity control in the antenna system or other means for combining the signals for example, FIG. 13, from U.S. patent application Ser. No. 09/905795 filed on the same date as this application and entitled "Communicating Simultaneously with a Satellite and a Terrestrial System" the disclosure of which is hereby incorporated herein by reference.

The resulting radiation pattern is shown by FIG. 9. The H-Plane does show improved low angle radiation, however the overall pattern in the E-Plane is reduced compared to the case of the narrow Hi-Z surface. The reason for this is that, as the waves propagate along the surface in the H-Plane, they progress in phase, so that various portions of the surface see a different phase. As a result, the edge of the Hi-Z surface that launches TM waves into the surrounding metal is not a constant phase. This causes destructive interference between various portions of the radiation coming from the edge of the Hi-Z surface. As a result the radiation into the E-Plane is reduced. In general the radiation pattern will represent a compromise between the E-Plane and the H-Plane which is controlled by adjusting the length of the Hi-Z surface.

In FIG. 9 the E-plane is shown by a thin line, and the H-plane is shown by a thick line. The antenna achieves improved low-angle radiation in the H-plane by allowing TE surface waves to propagate over a longer distance. The low-angle radiation in the E-plane is reduced compared to the case of the shorter Hi-Z surface because the phase progression of the TE waves over the longer distance of Hi-Z surface tends to produce destructive interference in the direction of the E-plane.

FIG. 10 is a schematic plan view of the antenna showing the preferred size ranges for the Hi-Z surface 30, the ground plane 40 and the peripheral margin 50. The Hi-Z 30 surface is preferably at least 2λ wide and at least λ/2 high and preferably λ high. The ground plane 40 preferably extends a distance of at least λ beyond the edge of the Hi-Z surface 30 in a direction parallel to the longitudinal axis of the wire antenna 10. The peripheral margin 50 is preferably formed of a Hi-Z surface material or a lossy material and extends a distance of at least λ/2 beyond the edge of the ground plane 40 in a direction parallel to the longitudinal axis of the wire antenna 10.

In this disclosure we have described various examples of antennas involving an area of Hi-Z Surface having square or rectangular shapes surrounded by an area of ordinary metal. Using the concepts described above, it should be apparent to those skilled in the art that other geometries will likely provide suitable radiation patterns. Considering FIG. 10 for the moment, there is no particular reason why the disclosed antenna could not be adapted to use a circular-shaped to ellipse-shaped Hi-Z surface 30. Other shapes will doubtlessly also be suitable. The basic idea behind this disclosure is based on a recognition of the fact that leaky TE waves may be used to provide improved low angle radiation into either the E-Plane or the H-Plane. As such, this invention is not limited to the geometries used in the examples given in this disclosure. Moreover, in the disclosed embodiments, the surface 30 is shown with only one bent wire antenna since the tests were conducted with a single bent wire antenna 10 on the Hi-Z surface 30. However, in commercial applications it is expected that multiple antennas will be used and/or that the present invention will be used in connection with other types of antennas in addition to bent wire antenna. For example, it is anticipated that patch antennas and flared notch antennas will be used in certain embodiments in place of the wire antennas disclosed herein.

Having described the invention in connection with certain preferred embodiments thereof, modification will now certainly suggest itself to those skilled in the art. The invention is not to be limited to the disclosed embodiments, except as is specifically required by the appended claims.

What is claimed is:

1. A method of making a thin, low-angle radiation antenna, comprising the steps of:

(a) substantially surrounding a high-impedance surface by a larger conductive surface having low-impedance surface; and (b) disposing at least one antenna element on said high-impedance surface, the antenna having an operating frequency which is in a frequency range for which the high impedance surface supports transverse-electric (TE) surface waves and couples same to transverse-magnetic (TM) surface waves in said conductive surface.

2. The method of claim 1 wherein the area of the high-impedance surface is completely surrounded by the larger conductive surface.

3. The method of claim 1 wherein the high-impedance surface has a sheet capacitance C and a sheet inductance L and wherein the operating frequency of the antenna falls within a range of:

$$\frac{1}{2\pi\sqrt{LC}}+\frac{\sqrt{L/C}}{4\cdot 377} \text{ to } \frac{1}{2\pi\sqrt{LC}}+\frac{3\sqrt{L/C}}{4\cdot 377}.$$

4. The method of claim 1 further including substantially surrounding the conductive surface with a marginal strip of high-impedance or lossy material.

5. The method of claim 1 wherein the high-impedance surface has a length to width ratio in the range of 0.5λ:1λ to 1λ:3λ and a thickness less than 0.1λ where λ is one wavelength of the operating frequency of the antenna.

6. The method of claim 1 wherein the conductive surface is a metal surface.

7. An antenna having increased low-angle radiation sensitivity comprising:

(a) a ground plane;

(b) a high impedance surface disposed on or in said ground plane;

(c) at least one antenna element disposed on said high impedance surface, said antenna element being sized to operate at an operating frequency;

(d) the high-impedance surface having a sheet capacitance C and a sheet inductance L and wherein the operating frequency of the antenna element falls with a range of:

$$\frac{1}{2\pi\sqrt{LC}}+\frac{\sqrt{L/C}}{4\cdot 377} \text{ to } \frac{1}{2\pi\sqrt{LC}}+\frac{3\sqrt{L/C}}{4\cdot 377}.$$

8. The antenna of claim 7 wherein the high-impedance surface has a length in the range of 0.5λ to 1λ and a width in the range of 1λ to 3λ and a thickness less than 0.1λ where λ is one wavelength of the operating frequency of the antenna element.

9. The antenna of claim 7 wherein said ground plane surrounds said high-impedance surface.

10. The antenna of claim 7 wherein a margin of high-impedance or lossy material is disposed at and beyond at least a portion of the peripheral edge of the ground plane.

11. The antenna of claim 7 wherein the antenna element is a wire antenna.

12. An antenna comprising:

(a) a relatively smaller high-impedance surface;

(b) a relatively larger conductive surface which at least partially surrounds the relative smaller high-impedance surface; and (c) at least one antenna element disposed on said high-impedance surface, the antenna having an operating frequency which is in frequency range for which the high impedance surface supports transverse-electric (TE) surface waves and couples same to transverse-magnetic (TM) surface waves in said conductive surface.

13. The antenna of claim 12 wherein the high-impedance surface is completely surrounded by the relatively larger conductive surface.

14. The antenna of claim 12 wherein the high-impedance surface has a sheet capacitance C and a sheet inductance L and wherein the operating frequency of the antenna falls with a range of:

$$\frac{1}{2\pi\sqrt{LC}}+\frac{\sqrt{L/C}}{4\cdot 377} \text{ to } \frac{1}{2\pi\sqrt{LC}}+\frac{3\sqrt{L/C}}{4\cdot 377}.$$

15. The antenna of claim 12 further including a marginal strip of high-impedance or lossy material substantially surrounding the conductive surface.

16. The antenna of claim 12 wherein the high-impedance surface has a length in the range of 0.5λ to 1λ and a width in the range of 1λ to 3λ where λ is one wavelength of the operating frequency of the antenna.

17. The antenna of claim 16 wherein the high impedance surface has a thickness less than 0.1λ.

18. A method of operating an antenna comprising the steps of:

disposing a high-impedance surface adjacent a relatively larger low-impedance surface;

disposing at least one antenna element on said high impedance surface; and exciting said at least one antenna element on the high-impedance surface in a frequency band which is centered on a point of a dispersion diagram of the high impedance surface, the point corresponding to where a transverse-electric (TE) band line associated with the high impedance surface crosses a light line indicating the behavior of light in free space.

19. The method of claim 18 wherein the frequency band is outside a conventional frequency band of operation for the high impedance surface, the method providing an enhanced low-angle radiation pattern compared with exciting the at least one antenna element in said conventional frequency band.

20. The method of claim 18 wherein the high-impedance surface has a length in the range of 0.5λ to 1λ and a width in the range of 1λ to 3λ where λ is one wavelength in the frequency band which is centered on said point of the dispersion diagram of the high impedance surface.

21. The method of claim 18 wherein said high-impedance surface is disposed on said relatively larger low-impedance surface.

* * * * *